United States Patent [19]

Endo

[11] Patent Number: 4,685,819

[45] Date of Patent: Aug. 11, 1987

[54] TOOTHBRUSH

[76] Inventor: Sasuke Endo, 802, Hiroo Nashonaru Koto, 10-32, Minami Azabu 5-Chome, Minato-Ku, Tokyo-To, Japan

[21] Appl. No.: 601,850

[22] Filed: Apr. 19, 1984

[30] Foreign Application Priority Data

| | | | |
|---|---|---|---|
| Apr. 20, 1983 | [JP] | Japan | 58-68450 |
| Aug. 15, 1983 | [JP] | Japan | 58-148137 |
| Feb. 8, 1984 | [JP] | Japan | 59-16570[U] |

[51] Int. Cl.[4] ..... B43K 5/06

[52] U.S. Cl. ..... 401/176

[58] Field of Search ..... 401/141, 151, 150, 176, 401/187, 286, 287

[56] References Cited

U.S. PATENT DOCUMENTS

| | | | |
|---|---|---|---|
| 2,308,078 | 1/1943 | Hendrickson | 222/387 |
| 2,737,329 | 3/1956 | Bolsey | 401/141 |
| 2,743,042 | 4/1956 | Burgin | 222/191 |
| 3,261,367 | 7/1966 | Pickering | 401/135 |
| 3,400,996 | 9/1968 | Vandergrift | 401/184 |
| 3,613,698 | 10/1971 | Fox | 401/176 |
| 3,937,235 | 2/1976 | Broughton | 132/84 B |

FOREIGN PATENT DOCUMENTS

| | | |
|---|---|---|
| 2630569 | 1/1978 | Fed. Rep. of Germany . |
| 929420 | 12/1949 | France . |
| 2222050 | 10/1974 | France . |
| 2357204 | 2/1978 | France . |

*Primary Examiner*—Robert Peshock

*Attorney, Agent, or Firm*—Wenderoth, Lind & Ponack

[57] ABSTRACT

A toothbrush has a handle, a bristle-planted rod and a pumping mechanism accommodated in the handle. The rod is slidably held, at its rear end, by the main body of the handle. When the rod is pushed rearward and thereafter released, the pumping mechanism is operated so as to suck tooth-brushing material from a container forming a part of the handle and so as to feed the sucked material to the bristle-planted surface of the rod.

6 Claims, 14 Drawing Figures

TOOTHBRUSH

BACKGROUND OF THE INVENTION

1. Field of the Invention

This invention relates to a toothbrush having a container for containing toothbrushing material in liquid or emulsion form.

2. Description of the Prior Art

There have been conventionally proposed various toothbrushes which contain therein tooth-brushing material in paste or emulsion form. These toothbrushes feed the material onto their bristle-planted portions when they are used for teeth-brushing operations. In those toothbrushes disclosed in Japanese Utility Model Publications Nos. 138966/1977 and 102374/1979, the material contained in their handles are extruded by extrusion members, such as a piston or another element. However, the operation for extruding the material is troublesome, and it is difficult to adjust the piston so as to extrude a necessary amount of the material. In a toothbrush of the type which contains a tooth-brushing material extrusion mechanism in its handle, much space is not allowed for the material. If the toothbrush is made disposable, the material runs out before its bristle-planted portion becomes useless, and it is inevitable to make the material refillable. Additionally the sealing is not carried out perfectly between the interior of its handle and the bristle-planted portion. Accordingly there has been a case wherein the material flows back into the interior of the handle from its user's mouth during the teeth-brushing operation. As described above, the conventional toothbrushes containing tooth-brushing material have these various drawbacks.

SUMMARY OF THE INVENTION

It is an object of this invention to provide a toothbrush containing a tooth-brushing material in liquid or emulsion form therein, which is structurally simple and can be operated by one hand to feed a necessary quantity of the material onto its bristle-planted surface.

According to this invention, there is provided a toothbrush comprising a bristle-planted rod which is provided, at its head, with a great number of bristles and a handle including a container for containing tooth-brushing material having a fluidity, wherein the mouth of the container is connected to the root portion of the rod, the toothbrushing material in the container being fed to a bristle-planted surface of the head of the rod through a material feeding passage formed in the rod, characterized in that the handle has a container for containing tooth-brushing material in liquid or emulsion form and a main body, the rear end of which is connected detachably to the mouth of the container, that the root portion of the rod is inserted axially slidably into the forward bearing portion of the main body in such a manner that rotation of the rod can be avoided by a rotation-preventing means, that in the main body, there is provided a pumping mechanism for sucking the tooth-brushing material from the container and feeding the sucked material to the bristle-planted surface of the rod through the material feeding passage formed in the rod, and that the pumping mechanism is operated in accordance with axial movements of the rod at the time when the rod is pushed rearward and returned forward.

The nature, utility, and further features of this invention will be more clearly apparent from the following detailed description with respect to preferred embodiments of the invention when read in conjunction with the accompanying drawings briefly described below.

DETAILED DESCRIPTION OF THE PREFERRED EMBODIMENTS

Figure 1:
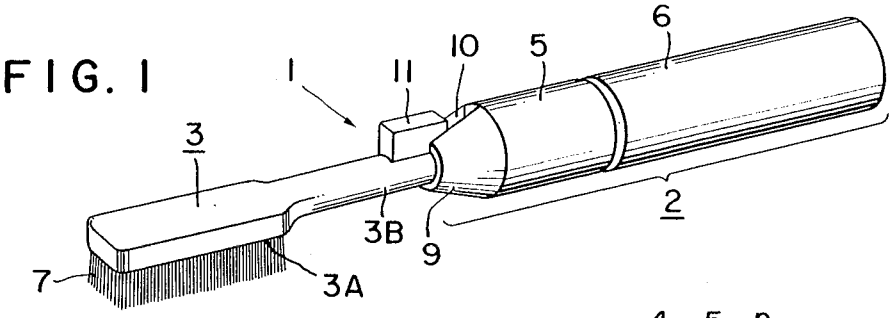
FIG. 1 is a perspective view of a first embodiment of a toothbrush of this invention.
Figure 2:
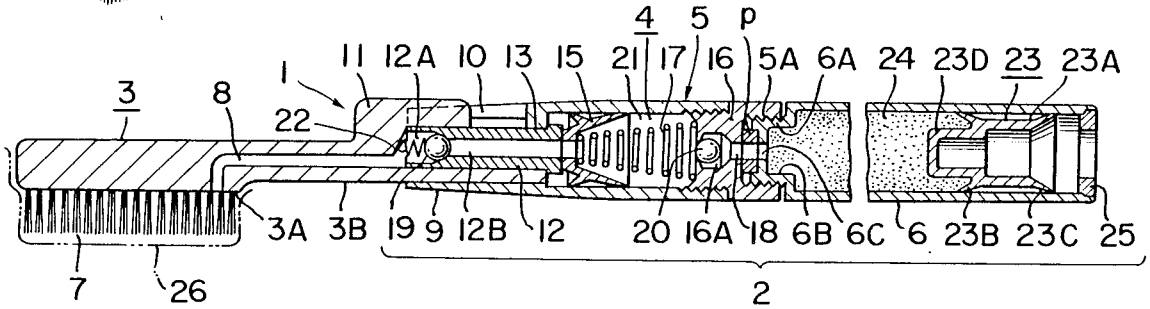
FIG. 2 is a vertical sectional view of a first embodiment of the toothbrush of this invention.

In FIGS. 1 and 2, a toothbrush 1 of this invention comprises a handle 2 and a bristle-planted rod 3 inserted in the forward end of the handle 2 slidably axially thereof, the handle 2 housing a pumping mechanism 4 for feeding tooth-brushing material in liquid or emulsion form.

The handle 2 comprises a combination of a main body 5 and a tooth-brushing material container 6 for housing a tooth-brushing material 24, connected to the handle body 5. The container 6 has a male thread 6A provided in the projected peripheral surface of the forward end thereof, and the body 5 has a female thread 5A provided in the inside peripheral surface of the rear portion thereof. The body 5 and the container 6 are connected detachably to each other by the screw-engagement of the male thread 6A with the female thread 5A.

The bristle-planted rod 3 is formed at its head, in a flat shape of rectangular section like a common toothbrush. The bristles 7 are planted in a bristle-planted surface 3A of the head of the rod 3. The rod 3 has a tooth-brushing material passage 8 provided in the interior thereof from a root portion 3B to the bristle-planting surface 3A thereof. The passage 8 opens directly on the bristle-planting surface 3A or is in communication with the planting holes of the respective bristles 7 planted in the bristle-planted surface 3A so that the tooth-brushing material 24 can be exuded at the roots of the bristles 7.

The rod 3 is slidably inserted at the root portion 3B thereof into the bearing portion 9 of the body 5 so as to keep a sealing function between the root portion 3B and the inside peripheral surface of the bearing portion 9. The bearing portion 9 has a slit 10 extending axially in the peripheral surface of the bearing portion 9. An operational projection 11 is protruded from the outside peripheral surface of the root portion 3B of the rod 3. The projection 11 is engaged slidably with the slit 10 to prevent the rod 3 from rotating about its axis.

The pumping mechanism 4 has an operational pipe 12 which is slidably inserted, at its forward portion, into the root portion 3B of the rod 3. The operational pipe 12 is inserted, at its rear portion, in a bearing hole 13 formed in the bottom of the bearing portion 9 of the body 5. The mechanism 4 has further a valve portion 15 formed in a bell-shape at the rear end of the operational pipe 12. The valve portion 15 is slidably disposed in the body 5 in close contact with the inside peripheral surface thereof, and a compression spring 17 for returning the rod 3 via the operational pipe 12 in their forward direction, interposed between the rear end of the operational pipe 12 and a valve seat member 16 screwed on the rear end of the body 5.

A forward valve body 19 and a rear valve body 20 both in the shape of a ball are disposed respectively in a larger-diameter portion 12A formed at the outer end of the operational rod 12 and at a larger-diameter portion 16A formed at the forward end of a suction hole 18 passing through the valve seat member 16. The forward valve body 19 disposed in the operational pipe 12 opens and closes the outer end of a conduit 12B in the pipe 12 thereby to communicate and uncommunicate the same with the passage 8. The forward valve body 19 is always urged rearward by a spring 22. The rear valve body 20 disposed in the valve seat member 16 opens and closes the suction hole 18 of the valve seat member 16. An airtight suction chamber 21 is defined in the main body 5. In the rear portion of the valve seat member 16 is provided a packing P for keeping an airtight contact between the front end of the container 6 and the rear end of the valve seat member 16.

The tooth-brushing material container 6 is joined to the main body 5 by engaging the male thread 6A with the female thread 5A in the valve seat member 16 with the packing P compressed between the forward end of the container 6 and the end face of the valve seat member 16. This joint brings the suction hole 18 of the valve seat member 16 into communication with the opening 6C of the container 6. The container 6 is provided with a bottom with a piston-like movable bottom body 23 which is slidable axially in close contact with the inside peripheral surface of the container 6. The movable bottom body 23 is made of soft synthetic resin or other material and has slide edges 23B and 23C which are expanded in a bell-shape respectively at the forward end and the rear end of a cylindrical portion 23A. The tight contact of the slide edges 23B and 23C with the inside peripheral wall of the container 6 ensures the airtightness so that an emulsified material or liquid material 24 filled in the container 6 may not leak therefrom.

At the forward end of the cylindrical portion 23A, there is provided a smaller-diameter cylindrical portion 23D which can be inserted in the projected smaller-diameter portion 6B of the mouth of the container 6 so that all material 24 can be completely consumed. A ring 25 prevents the movable bottom body 23 from dropping off from the rear end of the container 6. The ring 25 is inserted into the peripheral surface of the opened rear end of the container 6. At the same time, the ring 25 functions as a reinforcement member for preventing the deformation of the container by outside forces in order to keep the close contact of the slide edges 23B and 23C with the inside of the container 6.

The operation of the toothbrush 1 will be explained with reference to FIGS. 2 to 6.

Figure 3:
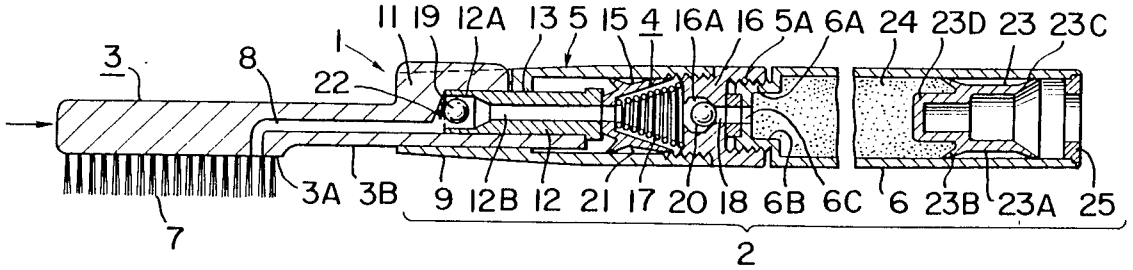
FIG. 3 is a vertical sectional view of the toothbrush of a first embodiment in the condition where a bristle-planted rod is pushed into a handle main body.

The handle 2 is held in one hand in the state shown in FIG. 2. When the brush 1 is used, the bristle-planted rod 3 is pushed rearward or toward the container 6 by putting a thumb on the operational projection 11, by pushing the tip of the rod 3 with the other hand, or by pressing the tip of the rod 3 against something like the bathroom wall. The rear portion of the rod 3 is pushed into the handle 2 along the bearing portion 9 as shown in FIG. 3 with the operational pipe 12 being pushed to advance in the handle main body 5. At this time, the forward valve body 19 opens the conduit 12B and the rear valve body 20 closes the suction hole 18.

Figure 4:
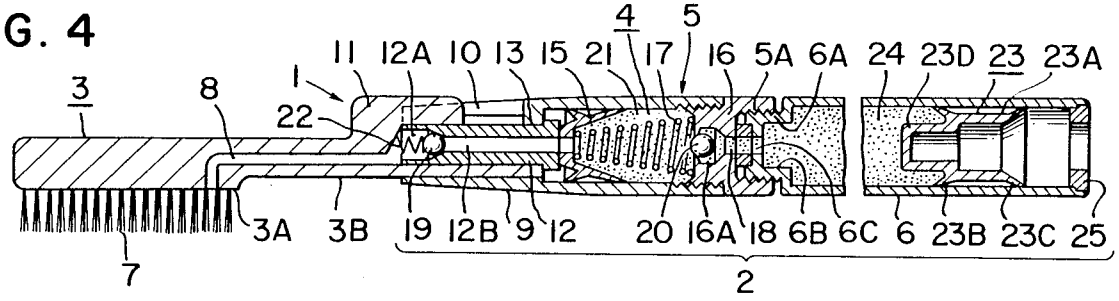
FIG. 4 is a vertical sectional view of the toothbrush of a first embodiment in the condition where the bristle-planted rod is returned after being pushed thereinto initially.

Then the rod 3 is freed from the pushing force so as to cause the repulsive force of the compressed spring 17 to push back the rod 3 and the pipe 12 to their respective forward positions. At this time the pressure in the suction chamber 21 of the body 5 becomes negative, a tooth-brushing material 24 in the container 6 is sucked into the suction chamber 21 of the body 5 through the suction hole 18 of the valve seat member 16 (FIG. 4). This suction results in a negative pressure in the container 6 to cause the movable bottom body 23 to advance for a short distance in close contact with the inside peripheral wall of the container 6.

Figure 5:
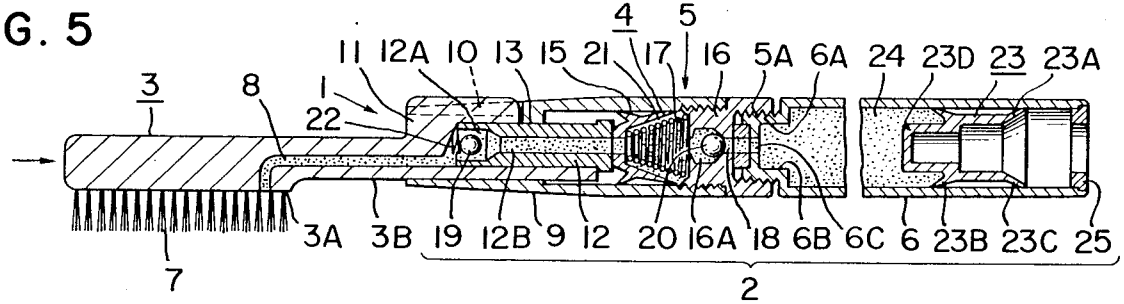
FIG. 5 is a vertical sectional view of the toothbrush of a first embodiment in the condition where the bristle-planted rod is again pushed to feed a toothbrushing material onto a bristle-planting surface after being once returned.
Figure 6:
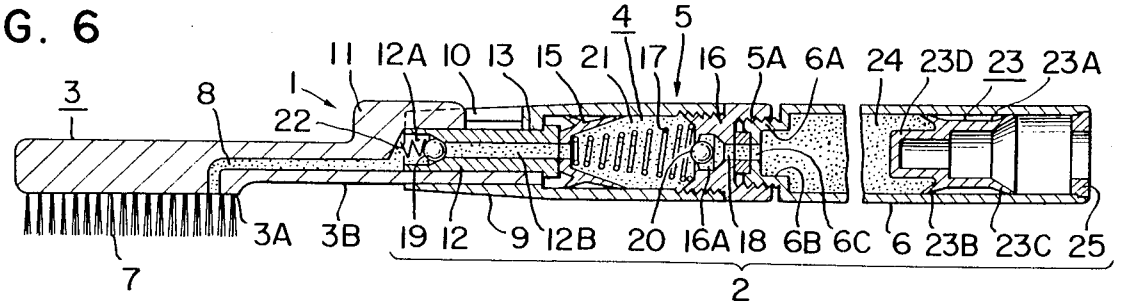
FIG. 6 is a vertical sectional view in the condition following the condition of FIG. 5, where the material is sucked into a suction chamber.

The rod 3 is again pushed rearward as described above. This time the forward valve body 19 opens the conduit 12B of the pipe 12 and the rear valve body 20 closes the suction hole 18 of the valve seat member 16. The tooth-brushing material sucked in the suction chamber 21 is fed into the conduit 12B of the pipe 12 and the tooth-brushing material passage 8 of the rod 3 (FIG. 5). Thereafter, the rod 3 is freed from the pushing force again, and the material 24 in the suction chamber 21 stops flowing forward and the material 24 in the container 6 is sucked from the container 6 into the suction chamber 21 of the body 5 (FIG. 6). Similarly as described above this suction causes the movable bottom body 23 in the container 6 to move forward in response to the sucked amount of the material 24.

When the toothbrush 1 is initially used, this operation is repeated two or three times to fill the body 5, the conduit 12B and the tooth-brushing material passage 8 with the material 24. After this, one push of the rod 3 feeds an amount of the material 24 suitable for one tooth brushing operation onto the bristleplanted surface 3A. Thus, the toothbrush 1 is ready for use. Individually, if the amount of the material 24 fed onto the surface 3A is not enough, two or more than two pushes will be given.

When the tooth-brushing material 24 in the container 6 has run out, the container 6 is unscrewed from the valve seat member 16, a cap (not shown) screwed on a fresh container 6 at the male thread 6A thereof is disengaged, and the male thread 6A of the fresh container is engaged with the female thread 5A of the body 5. Then immediately the toothbrush 1 can be again used continuously. When the tooth-brushing material passage 8 opening on the bristle-planting surface 3A of the rod 3 becomes dry during continuous use, the bristles 7 may be covered with a cap 26 as shown by a phantom line in FIG. 2.

The forward and the rear valve bodies 19 and 20 are not limited to the ball valve but may have any other structure which carries out the same function as the ball valve.

As described above, the toothbrush 1 of this invention comprises the bristle-planted rod 3 having the operational projection 11, and by the rod being pushed toward the main body 5, it can feed a certain amount of the tooth-brushing material 24 onto the bristle-planted surface 3A. Advantageously this makes it possible to brush teeth with one touch of an operation. Besides, since one push of the rod 3 feeds a predetermined amount of the material, its users do not need to pay attention to how much the material should be squeezed for one tooth-brushing operation as they do with the conventional tooth-brushing operation and wasteful use of excessive material can be avoided. Furthermore, the material 24 is fed by simply pushing the rod 3. Accordingly, even small children can use the toothbrush 1 easily. Additionally the tooth-brushing material container 6 is easily detached from the main body 5 and is disposable, and economically the main body 5 of the toothbrush can be used for a long time.

Especially in the toothbrush 1 of this invention, the movable bottom body 23 moves forward in response to a decrease of the material 24 in the container 6 when the rod 3 is pushed rearward to feed the material 24 toward the rod 3. This perfectly prevents air from being sucked from the outside into the material 24 in the container 6. It is desirable in terms of hygiene that the material can be fed in a perfectly sealed condition. Among other advantages, the toothbrush 1 of this invention comprises a small number of components and can be easily fabricated.

Other embodiments of this invention will be explained with reference to FIGS. 7 to 14.

Figure 7:
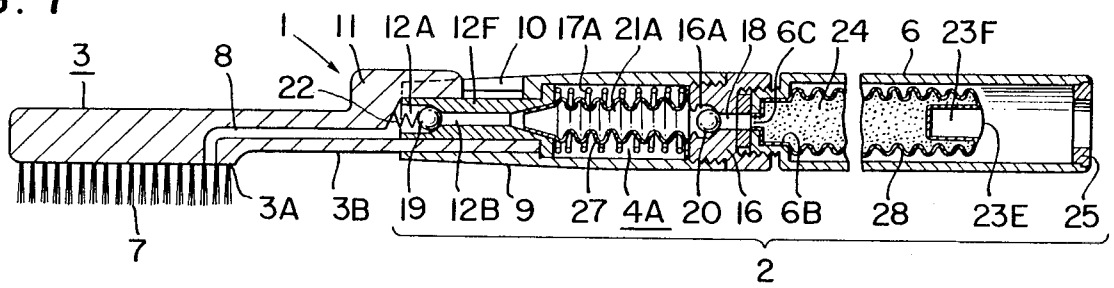
FIG. 7 is a vertical sectional view of a second embodiment of the toothbrush of this invention.

FIG. 7 illustrates a second embodiment of this invention.

In this embodiment, an operational pipe 12F and a valve seat member 16 are connected by a bellows 27 in place of the valve portion 15 of the operational pipe 12 of the first embodiment. The interior of the bellows 27 provides a suction chamber 21A. A compression spring 17A is disposed around the exterior of the bellows 27. In the container 6 there is provided a bellows 28 in which the material 24 is accommodated. At the bottom of the bellows 28 there is provided a movable bottom body 23E having a projection 23F to be inserted into the small-diameter portion 6B of the mouth of the container 6.

Except for the structure described above, the second embodiment is structurally identical with that shown in FIG. 2. The second embodiment has the same reference numerals as that described in the first embodiment for the identical structure and is described about the same.

The toothbrush of the second embodiment has a pumping mechanism 4A for sucking and feeding a tooth-brushing material 24 which is substantially identical with that of the material described in the first embodiment. When the bristle-planted rod 3 is pushed, the compressed spring 17A and the bellows 27 are compressed. At this time the forward valve body 19 opens the conduit 12B of the pipe 12F and the rear valve body 20 closes the hole 18 of the valve seat member 16. When the rod 3 is freed from the pushing force, the repulsive force of the compressed spring 17A pushes back the rod 3 with the bellows 27 being expanded. At this time the forward valve body 19 closes the conduit 12B and the rear valve body 20 opens the hole 18, and the tooth-brushing material 24 in the container 6 is sucked into the bellows 27 from the bellows 28. Repetition of this operation exudes a suitable amount of the material 24 onto the bristle-planted surface 3A as described in the first embodiment.

Figure 8:
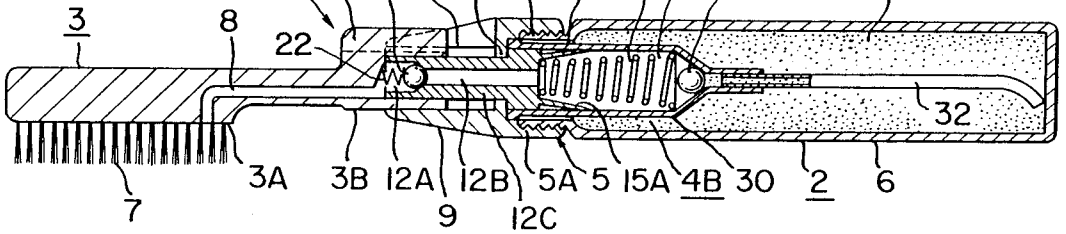
FIG. 8 is a vertical sectional view of a third embodiment of the toothbrush of this invention.

In a third embodiment shown in FIG. 8, there is provided a valve portion 15A which is formed in a bell-shape at the rear end of the operational pipe 12C, in a cylindrical valve case 30 fixedly connected to the main body 5, slidably in close contact therewith. A compression spring 31 is interposed between the rear end of the operational pipe 12C and the bottom of the valve case 30. The compression spring 31 serves to return the bristle-planted rod 3 via the operational pipe 12C to its forward position. The rear valve body 20 in the valve case 30 opens and closes the opening of a suction pipe 32 connected to the bottom of the valve case 30. The forward valve body 19 in the operational pipe 12C opens and closes the forward end of the operational pipe 12C to bring the operational pipe 12C into and out of communication with the tooth-brushing material passage 8.

On the side surface of the valve case 30 there are provided air-charge holes 33 of a very small diameter. When the material 24 is sucked into the container 6, the pressure in the container 6 becomes negative, making it difficult for the material 24 to be further sucked into the container 6. To avoid this, a small amount of air is charge through the holes 33 into the container 6.

In the toothbrush of this third embodiment, a pumping mechanism 4B operates in almost the same manner as the mechanism 4 described above. The handle 2 being held in one hand, the bristle-planted rod 3 is pushed rearward in a manner that a thumb is put on the operational projection 11 thereof. After the rod 3 is pushed into the main body 5 along the bearing portion 9 thereof, accordingly the operational pipe 12C is pushed into the valve case 30. At this time the forward valve body 19 is opened, the rear valve body 20 being closed. Then, the rod 3 is freed from the pushing force, the urging or repulsive force of the compression spring 31 returns the rod 3 to its forward position. At this time the operational pipe 12C is also returned to its forward position, making the pressure in the valve case 30 negative. Then the material 24 in the container 6 is sucked into the valve case 30 through the suction pipe 32. As described above, when the rod 3 is again pushed rearward, the operational pipe 12C goes into the body 5 and the material 24 in the valve case 30 is pushed out through the tooth-brushing material passage 8. Then when the rod 3 is freed from the pushing force again, the forward valve body 19 is closed, the rear valve body 20 being opened. Thus, again the material 24 is sucked into the valve case 30 from the container 6. After this operation, every one push of the rod 3 feeds a quantity of the material 24 suitable for one teeth-brushing operation to the bristle-planted surface 3A. Now the toothbrush of this third embodiment is ready for use.

Figure 9:
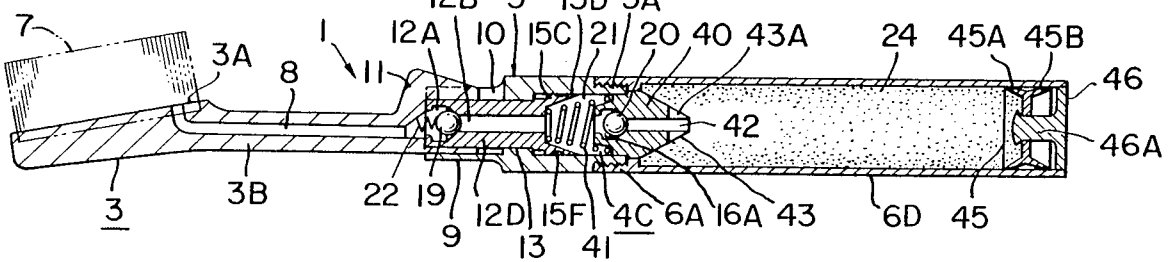
FIG. 9 is a vertical sectional view of a fouth embodiment of the toothbrush of this invention.
Figure 10:
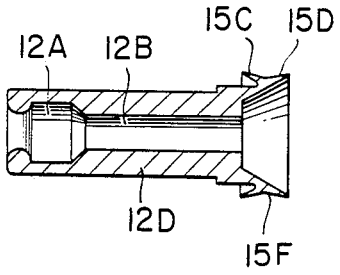
FIG. 10 is a vertical sectional view of an operational pipe of the fourth embodiment.

In the fourth embodiment shown in FIG. 9, a pumping mechanism 4C comprises an operational pipe 12D, the rear end of which is provided with a valve portion 15F slidably in close contact with the inside peripheral surface of the main body 5. The valve portion 15F has, as shown in FIG. 10, a slide portion 15C and a slide portion 15D expanded in a bell-shape respectively forward and rearward. Returning to FIG. 9, compression spring 41 is interposed between the rear end of the operational pipe 12D and a valve seat member 40 joined by being screwed, for example onto the rear end of the body 5. The compression spring 41 is for returning the rod 3 to their forward positions.

The forward ball-shaped valve body 19 and the rear ball-shaped valve body 20 are disposed respectively in the larger-diameter portion (valve chamber) 12A at the forward end of the operational pipe 12D and in the larger-diameter portion (valve chamber) 16A at the forward end of a suction hole 42 of the valve seat member 40. The forward valve body 19 in the operational pipe 12D opens and closes the conduit 12B of the operational pipe 12D thereby bringing the tooth-brushing material passage 8 into and out of communication therewith. The rear valve body 20 in the valve seat member 40 opens and closes the suction hole 42 of the valve seat member 40. The airtight suction chamber 21 is formed in the body 5. The spring 22 of a weak urging force constantly urges the forward valve body 19 in the direction to close the conduit 12B so that the forward valve body 19 may not open even when the toothbrush 1 is tilted with the rod 3 positioned than the bristles 7.

Figure 11:
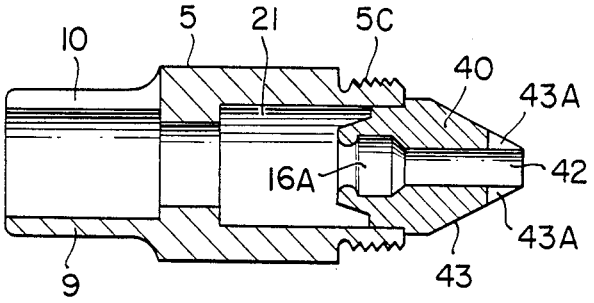
FIG. 11 is a vertical sectional view of an assembly of a handle main body and a valve seat.
Figure 12:
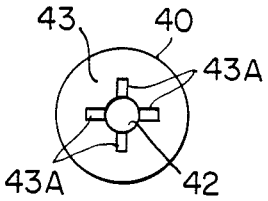
FIG. 12 is a side view of the valve seat.

The valve seat member 40, whose vertical section and end surface are illustrated in FIGS. 11 and 12, respectively, is in the form of a conical projection 43 which is decreasingly tapered toward the tip thereof. The conical projection 43 has, at its rear end, four slits 43A expanding radially from a suction hole 42 to form a sharp shape thereat. The conical projection 43 may be made of a different material from that of the forward portion of the valve seat member 40, and the shape of the conical projection 43 is not limited to the one shown in the fourth embodiment.

Figure 13:
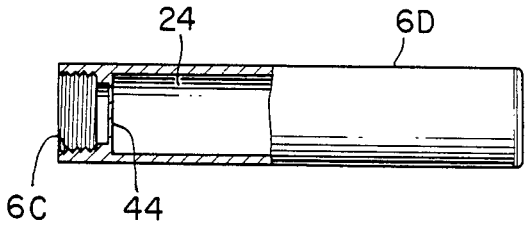
FIG. 13 is a partially broken side view of a tooth-brushing material container.

As shown in FIG. 13, the tooth-brushing material container 6D has a mouth sealed with a diaphragm 44. As described above, when a female thread 6C in the forward end of the container 6A is engaged with a male thread 5C at the rear end of the main body 5, the conical projection 43 breaks the diaphragm 44 thereby bringing the suction hole 42 of the valve seat member 40 in communication with the interior of the container 6D. When the toothbrush is not in use, a suitable cap (not shown) is screwed on the female thread 6C.

The bottom of the container 6D is provided with a piston-like movable bottom body 45 (FIG. 14) which is slidable axially in close contact with the inside peripheral surface of the container 6D. The movable bottom body 45 is made of soft synthetic resin or other material in the form illustrated in FIGS. 9 and 14. The movable bottom body 45 has slide edges 45A, 45B which are expanded in a bell-shape at the axially forward and the axially rear ends thereof and are reduced in thickness at the tips thereof. The slide edges 45A, 45B contact closely with the inside peripheral surface of the container 6D to retain the airtightness so that the material 24 in liquid or emulsion form in the container 6D may not leak.

Figure 14:
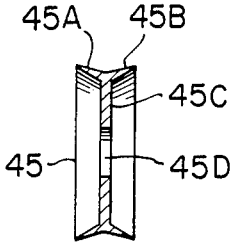
FIG. 14 is an enlarged sectional view of a movable bottom body.

As shown in FIG. 14, plate 45C of the movable bottom body 45 has a throughbore 45D for filling the material 24 into the container 6D therethrough, provided in the center thereof. Returning to FIG. 9, projected portion 46A of a seal member 46 is inserted into the throughbore 45D of FIG. 14 to close it. The seam member 46 of FIG. 9 also serves as a reinforcement member which prevents the container 6D from being deformed under the influence of exterior forces so that the close contact may not be impaired between the slide edges 45A, 45B between the inside peripheral surface of the container 6D.

In this fourth embodiment, while the container 6 is being screwed onto the main body 5, the sharp point of the projection 43 hits and breaks the diaphragm 44 shown in FIG. 13, and when the former is completely screwed on the latter, they are joined in the condition shown in FIG. 9 with the interior of the former being in communication with the valve chamber 16A through the suction hole 42. The pumping mechanism 4C operates in the same manner as that of each of the three embodiments described above. The material 24 sealed in the container 6D by the diaphragm 44 does not degrade. While the container 6D is being screwed onto the main body 5, the diaphragm 44 is automatically broken, communicating the interior of the body 5 with the container 6D. Consequently the material 24 does not leak out of the container 6D while both are being connected, and both can be readily connected.

What is claimed is:

1. A toothbrush comprising:

(a) a handle having a container for containing tooth-brushing material in liquid or emulsion form and a main body, a rear end of which is connected detachably to a mouth of the container, the container having a movable bottom body which moves along an inner wall of the container as the material is sucked through the mouth of the container;

(b) a bristle planted rod provided, at its head, with a great number of bristles, and slidably inserted, at its root portion, into a forward bearing portion of the main body in such a manner that rotation of the rod can be avoided and the rod can be reciprocated axially, and the rod having a material feeding passage extending therein from its root portion to a bristle planted surface of the head of the rod;

(c) a pumping mechanism disposed within the main body for sucking the tooth-brushing material from the container and feeding the sucked material to the bristle planted surface, and operated in accordance with reciprocal axial movements of the rod, the pumping mechanism including a suction chamber disposed within the main body, sealing means within the suction chamber for effecting a vacuum in the suction chamber to suck the material from the container into the suction chamber, the suction chamber being in fluid communication with the mouth of the container, the sealing means including forward and rearward slide portions for slidingly engaging the inner wall of the suction chamber and for maintaining an airtight connection between the sealing means and the suction chamber, an operational pipe slidably mounted in the main body and connected between the rod and the sealing means, the operational pipe providing fluid communication between the material feeding passage in the rod and the suction chamber for pumping material to the bristle planted surface of the rod in response to reciprocal axial movement of the rod, the operational pipe and the sealing means, the pumping mechanism further including a valve body disposed between the container and the suction chamber for preventing the rearward flow of material from the suction chamber back into the container and a valve body positioned forwardly of the sealing means for preventing rearward flow of the material from the rod back into the suction chamber;

(d) elastic means disposed within the suction chamber for biasing the rod in an axial position with respect to the main body of the handle;

(e) a rotation-preventing means including an operational projection formed on a peripheral surface of the root portion of the rod and functioning as a pushing member on which a finger is put when the rod is pushed axially; and (f) a slit means, axially provided in a bearing portion of the main body, for slidably receiving the operational projection.

2. The toothbrush of claim 1, wherein the elastic means in the suction chamber comprises a spring which biases the rod forwardly with respect to the main body of the handle.

3. The toothbrush of claim 2, wherein the spring engages a rear wall of the suction chamber and a rear surface of the sealing means for urging the rod forwardly with respect to the main body of the handle.

4. The toothbrush of claim 1, wherein the valve body disposed between the container and the suction chamber for preventing rearward flow of material from the suction chamber back into the container comprises a ball which is received within a valve seat member, the valve seat member including a suction hole which provides the fluid communication between the suction chamber and the container, the ball preventing the rearward flow of material from the suction chamber to the container when material is pumped to the bristle planted surface of the rod by reciprocal axial movement of the rod.

5. The toothbrush of claim 1, wherein the valve body positioned forwardly of the sealing means for preventing rearward flow of the material from the rod back into the suction chamber comprises a ball which is received in a larger-diameter portion formed at the forward end of the operational rod, the ball being urged rearwardly by a spring for preventing rearward flow of the material from the rod back into the suction chamber when material is pumped to the bristle planted surface of the rod by reciprocal axial movement of the rod.

6. The toothbrush of claim 1, wherein the container is sealed with a diaphragm, a rear valve seat is provided on the rear end of the main body, the rear valve seat receiving the rear valve body for preventing the rearward flow of material from the suction chamber back into the container, and at least one sharp projection extending rearwardly of the rear valve seat for breaking the diaphragm when the container is connected to the main body of the handle.

* * * * *